US009217259B1

(12) United States Patent
Perrotta

(10) Patent No.: US 9,217,259 B1
(45) Date of Patent: Dec. 22, 2015

(54) INFLATABLE POOL FOR USE WITH A PLAYSET SLIDE

(71) Applicant: Karen J. Perrotta, Waxhaw, NC (US)

(72) Inventor: Karen J. Perrotta, Waxhaw, NC (US)

( * ) Notice: Subject to any disclaimer, the term of this patent is extended or adjusted under 35 U.S.C. 154(b) by 473 days.

(21) Appl. No.: 13/776,962

(22) Filed: Feb. 26, 2013

(51) Int. Cl.
*E04H 4/00* (2006.01)
*E04H 4/14* (2006.01)

(52) U.S. Cl.
CPC ..... *E04H 4/14* (2013.01); *E04H 4/0025* (2013.01); *E04H 4/0031* (2013.01)

(58) Field of Classification Search
CPC ..... E04H 4/0025; E04H 4/0031; E04H 4/14
USPC ..... 4/506; 472/117
See application file for complete search history.

(56) References Cited

U.S. PATENT DOCUMENTS

| | | | | |
|---|---|---|---|---|
| 4,754,502 | A * | 7/1988 | Bowen | 4/508 |
| 4,805,898 | A | 2/1989 | Jacober et al. | |
| 5,478,281 | A | 12/1995 | Forton | |
| 5,865,679 | A * | 2/1999 | Seabolt et al. | 472/117 |
| D409,707 | S | 5/1999 | Peterson | |
| 6,062,983 | A | 5/2000 | Butsook | |
| 6,406,377 | B1 | 6/2002 | Demko | |
| 6,582,315 | B1 | 6/2003 | Formanski | |
| 2011/0094025 | A1 * | 4/2011 | West | 4/506 |

* cited by examiner

*Primary Examiner* — Tuan N Nguyen

(57) ABSTRACT

The inflatable pool for use with a playset slide is used in conjunction with a water sprayer in order to transform a playset slide into a water slide. The inflatable pool is adapted for use with the bottom portion of the playset slide, and includes a rigid member adjacent to a distal end, and which is integrated into the design of the bottom. Inflatable walls work with the bottom to form the shape of the pool, which collects water sliding down from the slide, and provides a soft landing for an end user. The water sprayer is adapted to connect with a garden hose in order to administer water to the top portion of the slide, and also includes a bracket thereon in order to secure itself to the top portion of the water slide or onto structure located adjacent thereto.

8 Claims, 5 Drawing Sheets

INFLATABLE POOL FOR USE WITH A PLAYSET SLIDE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of playset equipment and water slides, more specifically, a pool specifically adapted for use with an existing playset slide, and which enables transformation to a water slide.

B. Discussion of the Prior Art

As will be discussed immediately below, no prior art discloses an inflatable pool of a shallow depth, which is comprised of inflatable walls defining periphery of the inflatable pool, and a bottom; wherein the bottom features a rigid member adjacent a distal end, which enables a bottom portion of a slide to be rested or seated thereon, and which does not tear or otherwise break the bottom; wherein the bottom and the inflatable walls collectively form the overall shape when in use; wherein the rigid member enables the inflatable pool to act as a receiving end for an end user sliding down said slide, which may be supplied water from a top portion in order to adapt said slide into an active water slide; wherein a water sprayer is adapted to connect with a garden hose in order to administer water to the top portion of the slide; wherein the sprayer may include a bracket that secures the water sprayer to the top portion of the water slide or other structure in order to suspend said water sprayer above the water slide in order to form a water shower effect onto the top portion of the water slide.

The Jacober et al. Patent (U.S. Pat. No. 4,805,898) discloses a combined slide and swimming pool in which the slide can be connected to a water hose for creating a water slide and pool. However, the pool and the slide are integrated together in design, and is not adapted to work with an existing playset styled slide, which is temporarily transformed into a water slide.

The Demko Patent (U.S. Pat. No. 6,406,377) discloses an inflatable swimming pool and combined slide in which a water hose is connected to the slide. Again, the swimming pool and slide are integrated collectively together, and is not a swimming pool adapted for use with an existing playset slide.

The Forton Patent (U.S. Pat. No. 5,478,281) discloses a portable slide that can be connected to a water hose for sliding into a swimming pool. However, the portable slide is designed for use with an existing swimming pool.

The Butsook Patent (U.S. Pat. No. 6,062,983) discloses a combined water slide and pool apparatus in which a hose is connected to the slide. Again, the water slide and pool are built together, and not adapted for use with an existing playset water slide.

The Formanski Patent (U.S. Pat. No. 6,532,315) discloses a slide for backyard use in which a water hose is connected to the top and the end of the slide, which can be inserted into a pool. However, the portable slide is designed for use with an existing swimming pool.

The Peterson Patent (U.S. Pat. No. Des. 409,707) illustrates a design for an inflatable swimming pool apparatus, which does not depict a rigid member specifically located on the inflatable bottom.

While the above-described devices fulfill their respective and particular objects and requirements, they do not describe an inflatable pool of a shallow depth, which is comprised of inflatable walls defining periphery of the inflatable pool, and a bottom; wherein the bottom features a rigid member adjacent a distal end, which enables a bottom portion of a slide to be rested or seated thereon, and which does not tear or otherwise break the bottom; wherein the bottom and the inflatable walls collectively form the overall shape when in use; wherein the rigid member enables the inflatable pool to act as a receiving end for an end user sliding down said slide, which may be supplied water from a top portion in order to adapt said slide into an active water slide; wherein a water sprayer is adapted to connect with a garden hose in order to administer water to the top portion of the slide; wherein the sprayer may include a bracket that secures the water sprayer to the top portion of the water slide or other structure in order to suspend said water sprayer above the water slide in order to form a water shower effect onto the top portion of the water slide. In this regard, the inflatable pool for use with a playset slide departs from the conventional concepts and designs of the prior art.

SUMMARY OF THE INVENTION

The inflatable pool for use with a playset slide is used in conjunction with a water sprayer in order to transform a playset slide into a water slide. The inflatable pool is adapted for use with the bottom portion of the playset slide, and includes a rigid member adjacent to a distal end, and which is integrated into the design of the bottom. Inflatable walls work with the bottom to form the shape of the pool, which collects water sliding down from the slide, and provides a soft landing for an end user. The water sprayer is adapted to connect with a garden hose in order to administer water to the top portion of the slide, and also includes a bracket thereon in order to secure itself to the top portion of the water slide or onto structure located adjacent thereto so as to provide a water shower effect onto the top portion of the water slide.

It is an object of the invention to provide an inflatable pool and elongated sprayer, which work with an existing playset slide in order to transform said slide into a water slide.

A further object of the invention to provide an inflatable swimming pool, which includes a rigid member near a distal end, which supports the weight of the bottom portion of the slide thereon.

A further object of the invention is to provide an inflatable swimming pool that is generally rectangular such that as an end user slides down said slide, the end user may fall forwardly into said inflatable swimming pool.

Another object of the invention is to include a water sprayer that is configured to attach onto an existing garden hose so as to produce a series of small water sprays that can be directed onto a top portion of the playset slide in order to transform said slide into a water slide.

An even further object of the invention is to include a bracket on said water sprayer, which secures said water sprayer to either structure located over top of the slide or adjacent to said slide thereby eliminating the need to manually hold the water sprayer when in use in transforming the slide into a water slide.

These together with additional objects, features and advantages of the inflatable pool for use with a playset slide will be readily apparent to those of ordinary skill in the art upon reading the following derailed description of presently preferred, but nonetheless illustrative, embodiments of the inflatable pool for use with a playset slide when taken in conjunction with the accompanying drawings.

In this respect, before explaining the current embodiments of the inflatable pool for use with a playset slide in detail, it is to be understood that the inflatable pool for use with a playset slide is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the inflatable pool for use with a playset slide.

It is therefore important that the claims be regarded as including such equivalent construction insofar as they do not depart from the spirit and scope of the inflatable pool for use with a playset slide. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
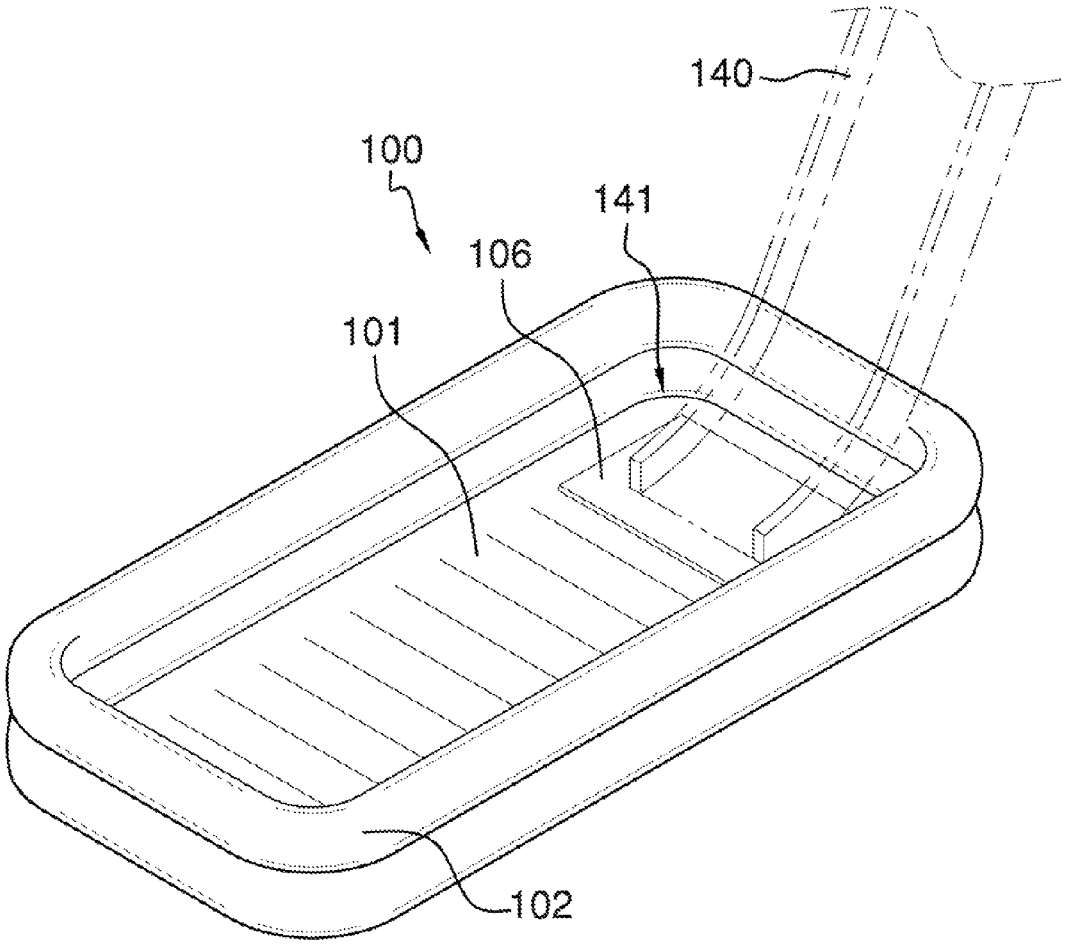
FIG. 1 illustrates a perspective view of the inflatable swimming pool in which the bottom portion of the slide is depicted in hashed lines and aligned with the rigid member.
Figure 2:
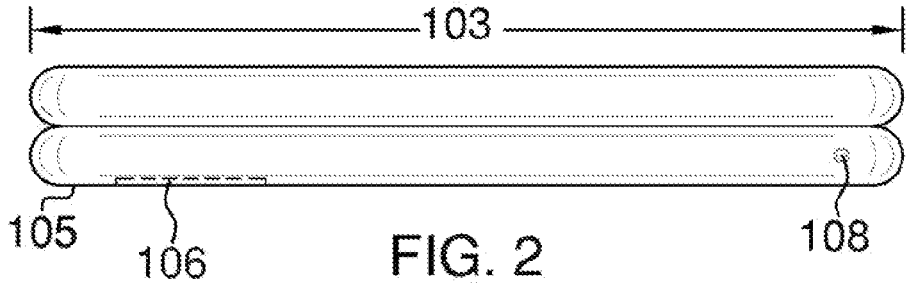
FIG. 2 illustrates a side view of the inflatable swimming pool by itself.
Figure 3:
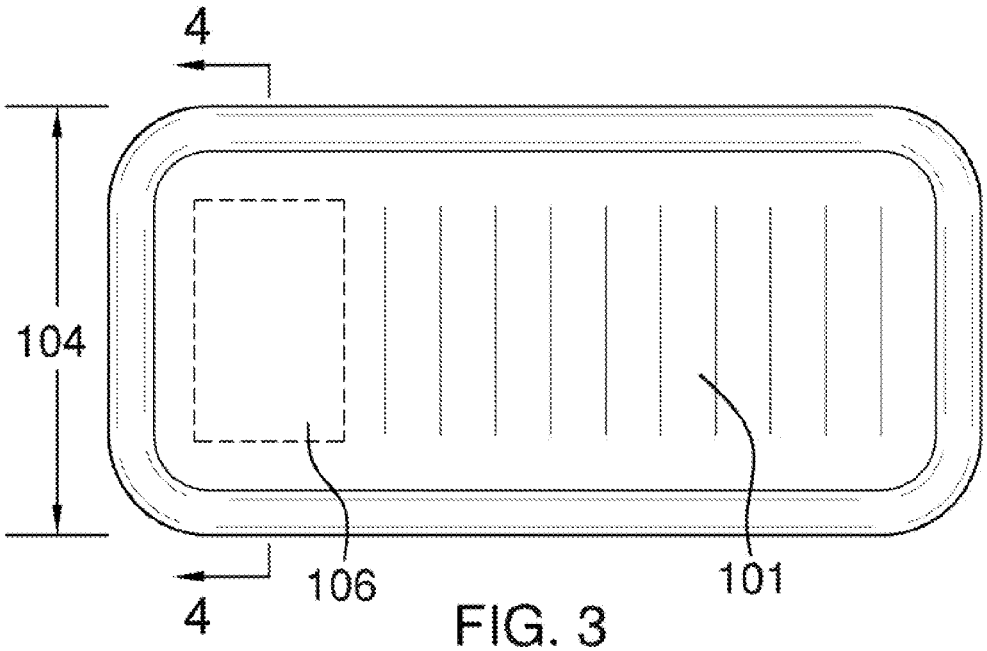
FIG. 3 illustrates a top view of the inflatable swimming pool by itself.
Figure 4:
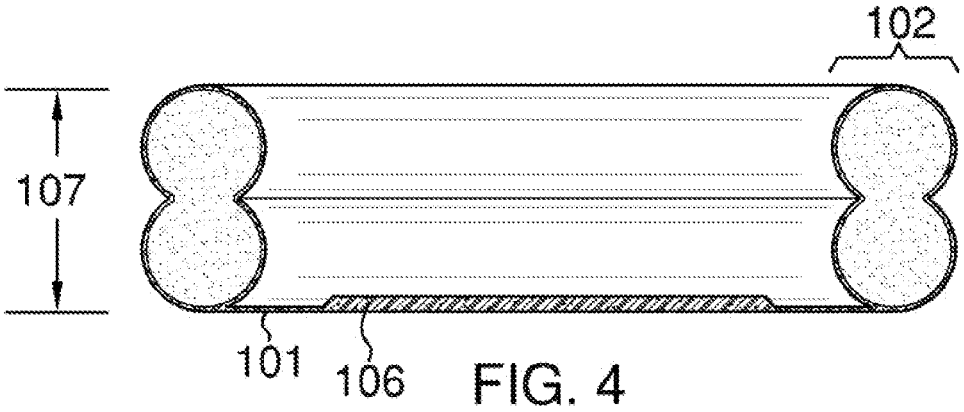
FIG. 4 illustrates a cross-sectional view of the inflatable swimming pool along lines 4-4 in FIG. 3.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-8. An inflatable pool for use with a playset slide 100 (hereinafter invention) includes a bottom 101 that is lined with inflatable walls 102 surrounding all sides of said bottom 101. The bottom 101 is further defined with a length 103 and a width 104, and features a distal end 105 that includes a rigid member 106 thereon. The inflatable walls 102 extending vertically a height 107 to form the overall shape of the inflatable swimming pool of the invention 100.

The bottom 101 and the inflatable walls 102 are manufactured of an impermeable material, such as a rubber, vinyl, or plastic that enables water 130 to fill in the inflatable swimming pool of the invention 100. Moreover, the rigid member 106 is located adjacent to the distal end 105, and enables a bottom portion 141 of an existing playset slide 140 to rest thereon.

The rigid member 106 is important to the invention 100 in that the rigid member 106 insures that the playset slide 140 does not damage the integrity of the bottom 101, or prevent tearing of the bottom 101, which would otherwise impede use of the invention 100. The rigid member 106 is a generally square or rectangular shaped object having a thin profile, and is ideally made of a material strong enough to deal with forces associated with the use of the playset slide 140. Moreover, the rigid member 106 shall be made of a material comprising a carbon fiber composite, a plastic, a metal, or an aramid fiber.

The inflatable walls 102 include a plug 108, which enables inflation and deflation of the inflatable walls 102. It shall be noted that the inflatable walls 102 define the perimeter, and retain the water 130 that falls therein from the playset slide 140.

Figure 5:
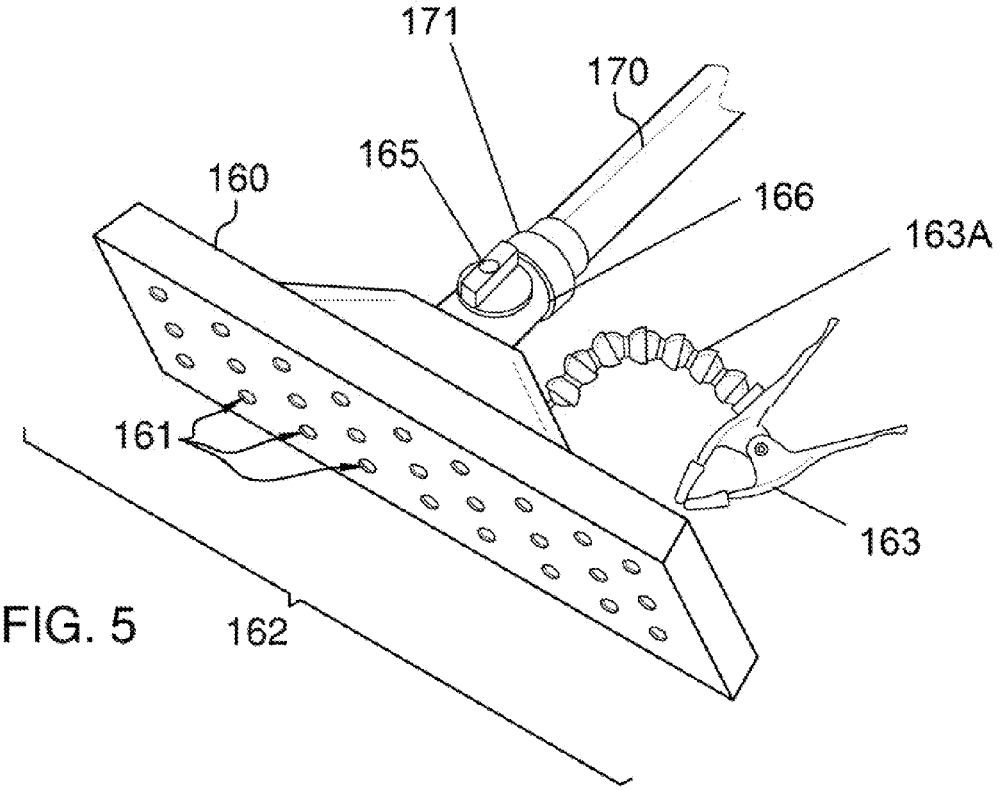
FIG. 5 illustrates a perspective view of the water sprayer and clamp.
Figure 6:
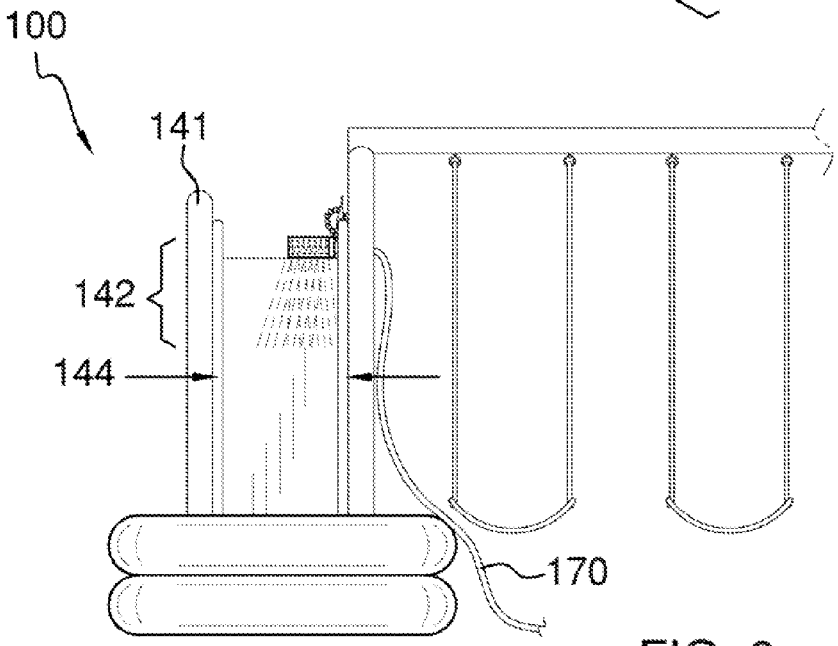
FIG. 6 illustrates a front view of the inflatable pool for use with a playset slide in use with an existing playset slide.

The invention 100 includes a water sprayer 160 that includes a plurality of sprayer nozzles 161 aligned a sprayer length 162. The water sprayer 160 is correctable with a garden hose 170, and also includes a clamp 163, which enables the water sprayer 160 to secure itself to a top portion 142 of the slide 140. Referring to FIGS. 5-6, the water sprayer 160 shall dispense water via the sprayer nozzles 161 spanning a width 144 of the slide 140.

Figure 7:
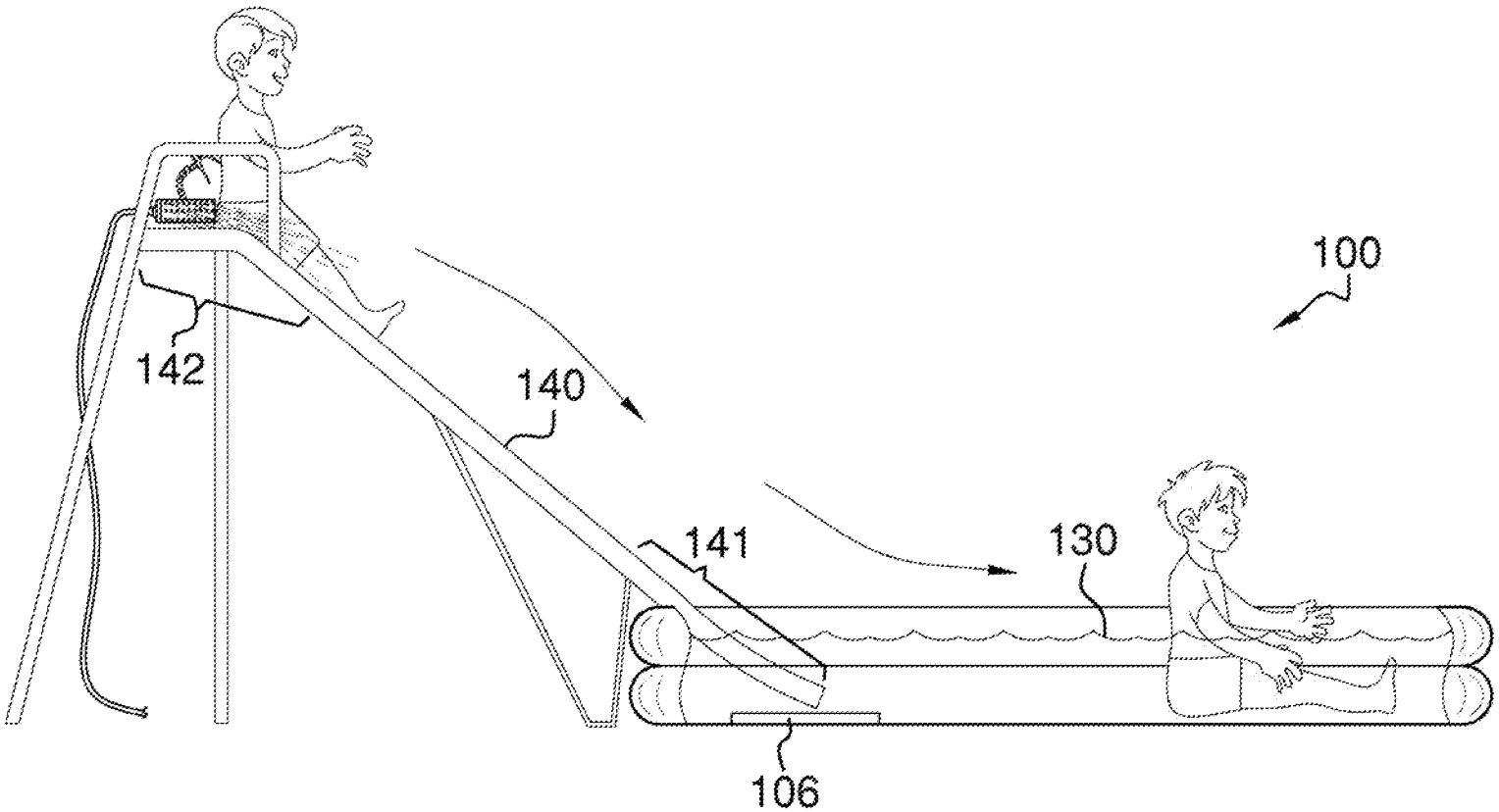
FIG. 7 illustrates a side cut-away view of the inflatable pool for use with a playset slide in use with an end user sliding down said slide and arriving into the inflatable swimming pool, which is filled with water.

Referring to FIG. 7, the clamp 163 supports the water sprayer 160 onto a slide ladder 147 such that the water sprayer 160 can operate hands-free. The clamp 163 is a spring-loaded device that includes an adjustable arm 163A, which connects the clamp 163 to the water sprayer 160. The adjustable arm 163A provides flexibility in aiming the water sprayer 160 with respect to the object of which said water sprayer 160 is being held in place.

Figure 8:
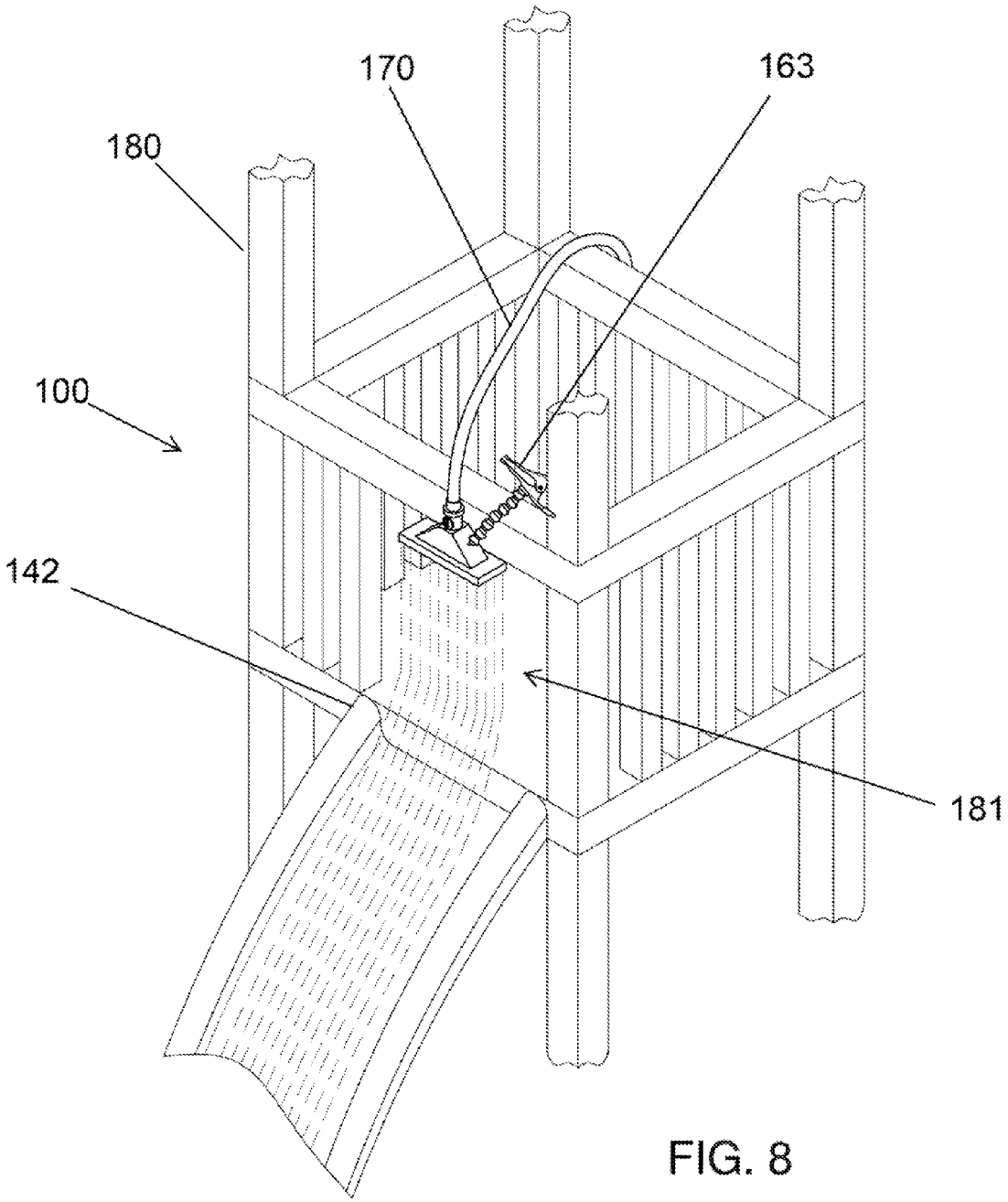
FIG. 8 illustrates a perspective view of the water sprayer secured or suspended above an opening to the water slide, and forming the water shower effect onto the top portion of the water slide.

Referring to FIG. 8, the water sprayer 160 may be hung over the top of an opening 181 of another playset 180. FIGS. 7 and 8 illustrate the different means of positioning the water sprayer 160 with respect to different structures (slide ladder 147 and playset 180, respectively). The opening 181 is presented with a water shower effect 182 that falls onto the top portion 142 of the slide 140.

The water sprayer 160 may include an on/off switch 165, which can turn on or off the water being supplied via the garden hose 170. The on/off switch 165 is located between the sprayer nozzles 161 and where a female threaded member 171 of the garden hose 170 connects with a male threaded member 166. The on/off switch 165 is included on the water sprayer 160 such that then end user can turn off water where the inflatable walls 102 of the inflatable swimming pool of the invention 100 are filled to capacity or where the invention 100 is between uses.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to not be limited only by the scope of the following claims and their equivalents.

The inventor claims:

1. An inflatable pool for use with a playset slide comprising:
- a bottom that is lined with inflatable walls surrounding all perimeter sides of the bottom;
- wherein the inflatable walls extend vertically to form an overall shape of the inflatable pool, which is generally rectangular;
- wherein the bottom includes a rigid member that is adapted for a bottom portion of a playset slide to rest thereon;
- wherein said slide is provided water, which transforms said slide into a water slide, and to which said water shall flow down said slide and into said inflatable pool, which acts as a receiving end for an end user sliding down said water slide;
- wherein a water sprayer is included and supplies water to a top portion of said playset slide;
- wherein the water sprayer includes a plurality of sprayer nozzles aligned along a sprayer length, which collectively dispense water across a width of said slide;
- wherein the water sprayer is configured for connection with a garden hose, and includes a clamp that enables the water sprayer to secure itself to a top portion of the slide or a slide ladder in order for the water sprayer to operate hands-free or to hang the water sprayer overtop of structure associated with the slide via the garden hose;
- wherein the clamp is spring-loaded and includes an adjustable arm that connects between the clamp and the water sprayer so as to provide for adjustment of direction of the water sprayer.

2. The inflatable pool for use with a playset slide as described in claim 1 wherein the bottom is further defined with a length and a width, and features a distal end that includes the rigid member thereon.

3. The inflatable pool for use with a playset slide as described in claim 2 wherein the inflatable walls extending vertically a height.

4. The inflatable pool for use with a playset slide as described in claim 3 wherein the bottom and the inflatable walls are made of an impermeable material.

5. The inflatable pool for use with a playset slide as described in claim 1 wherein the rigid member has a thin profile, and a square or rectangular shape.

6. The inflatable pool for use with a playset slide as described in claim 1 wherein the water sprayer includes an on/off switch, which can turn on or off the water being supplied via the garden hose; wherein the on/off switch is located between the sprayer nozzles and where a female threaded member of the garden hose connects with a male threaded member.

7. An inflatable pool for use with a playset slide comprising:
- a bottom that is lined with inflatable walls surrounding all perimeter sides of the bottom;
- wherein the inflatable walls extend vertically to form an overall shape of the inflatable pool, which is generally rectangular;
- wherein the bottom includes a rigid member that is adapted for a bottom portion of a playset slide to rest thereon;
- wherein said slide is provided water, which transforms said slide into a water slide, and to which said water shall flow down said slide and into said inflatable pool, which acts as a receiving end for an end user sliding down said water slide;
- wherein the bottom is further defined with a length and a width, and features a distal end that includes the rigid member thereon;
- wherein a water sprayer is included and supplies water to a top portion of said playset slide;
- wherein the inflatable walls extending vertically a height;
- wherein the bottom and the inflatable walls are made of an impermeable material;
- wherein the rigid member has a thin profile, and a square or rectangular shape;
- wherein the water sprayer includes a plurality of sprayer nozzles aligned along a sprayer length, which collectively dispense water across a width of said slide;
- wherein the water sprayer is configured for connection with a garden hose, and includes a clamp that enables the water sprayer to secure itself to a top portion of the slide or a slide ladder in order for the water sprayer to operate hands-free or to hang the water sprayer overtop of structure associated with the slide via the garden hose;
- wherein the clamp is spring-loaded and includes an adjustable arm that connects between the clamp and the water sprayer so as to provide for adjustment of direction of the water sprayer.

8. The inflatable pool for use with a playset slide as described in claim 1 wherein the water sprayer includes an on/off switch, which can turn on or off the water being supplied via the garden hose; wherein the on/off switch is located between the sprayer nozzles and where a female threaded member of the garden hose connects with a male threaded member.

* * * * *